US006875909B1

(12) United States Patent
Cruz

(10) Patent No.: US 6,875,909 B1
(45) Date of Patent: Apr. 5, 2005

(54) 92 KEY PIANO

(76) Inventor: Reynaldo A. Cruz, P.O. Box 9273, Long Beach, CA (US) 90810

( * ) Notice: Subject to any disclaimer, the term of this patent is extended or adjusted under 35 U.S.C. 154(b) by 57 days.

(21) Appl. No.: 10/291,355

(22) Filed: Nov. 8, 2002

Related U.S. Application Data

(60) Provisional application No. 60/346,421, filed on Nov. 9, 2001.

(51) Int. Cl.[7] ..... G10C 1/00

(52) U.S. Cl. ..... 84/174

(58) Field of Search ..... 84/173, 174, 175, 84/199, 200, 216, 170, 171, 172

(56) References Cited

U.S. PATENT DOCUMENTS 3,757,024 A * 9/1973 Stinson et al. ..... 84/716

4,130,044 A * 12/1978 Yamada et al. ..... 84/176

OTHER PUBLICATIONS

New Orleans Magazine (v27, n9, p112(2) Jun. 1993).*

Bosenforfer pianos v68 n3m p77, p.1 Mar. 2001.*

* cited by examiner

*Primary Examiner*—Kimberly Lockett
(74) *Attorney, Agent, or Firm*—Kenneth L. Tolar

(57) ABSTRACT

A versatile, high performance grand piano includes a keyboard having 92 keys thereon as opposed to the conventional 88 keys found on most pianos. Furthermore, each key hammer strikes four dedicated strings as opposed to the three shared strings found on conventional pianos. The string construction eliminates the need for string sets to be shared with adjacent keys so that tuning or breakage of a string only affects a single key as opposed to adjacent keys.

6 Claims, 3 Drawing Sheets

92 KEY PIANO

This application is entitled to the benefit of provisional application No. 60/346,421 under 35 U.S.C. Section 119(e), filed on Nov. 9, 2001.

BACKGROUND OF THE INVENTION

The present invention relates to a piano having 92 keys as opposed to the conventional 88 keys found on most pianos thereby providing enhanced versatility and performance.

DESCRIPTION OF THE PRIOR ART

Conventional pianos include 88 keys, each of which operates a hammer that strikes a set of three adjacent strings-a right string, a left string and an intermediate string. The right and left strings for each key are shared with the adjacent keys. For example, the right string for a given key functions as the left string for the key immediately to the right of the given key. Likewise, the left string is shared with the left adjacent key and becomes the right string therefor. Accordingly, if a string associated with a given key breaks during a concert or other performance, the sound quality and volume of two notes are affected. Similarly, tuning a single string will affect two notes simultaneously. Furthermore, with a traditional 88-key piano, the middle C note is not centrally positioned on the keyboard. Finally, a conventional piano includes sets of treble and bass strings that overlap making its impossible to individually expose either set.

The present invention satisfies the above-described problems by providing a 92-key piano that includes an additional four notes for enhanced versatility and which allows the middle C note to be positioned at the keyboard median. Furthermore, each key includes four dedicated, unshared strings that emit a higher quality sound and do not affect other notes if broken or tuned. Additionally, the bass strings and treble strings are segregated allowing either or both to be exposed with a pair of lids, each overlaying a designated set.

SUMMARY OF THE INVENTION

The present invention discloses a 92-key piano including a conventional housing having a keyboard and a hollow interior containing conventional piano sound producing means such as strings, hammers and similar items. The keyboard includes 92-keys, preferably 38 black keys and 54 white keys. The additional four keys are located to the left side of the original 88 keys which are tuned up by four notes as compared to a conventional 88 key piano. Accordingly, the additional four notes included in the 92-key board increases the playing range. In addition, each key operates a hammer that strikes four designated strings rather than the conventional three strings resulting in a more intense and powerful sound than that created with the three string arrangement. Furthermore, each string includes a designated tuning pin whereby each of the four strings for a designated key can be separately tuned so as not to affect the sound quality of any adjacent keys or notes.

It is therefore an object of the present invention to provide a piano having a greater range in which a user may play.

It is another object of the present invention to provide a piano whereby each key has designated strings that are not shared by other keys so that a string failure only affects the designated key.

It is yet another object of the present invention to provide a piano in which each string has a designated tuning pin whereby tuning one string does not affect the playing quality of an adjacent key.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
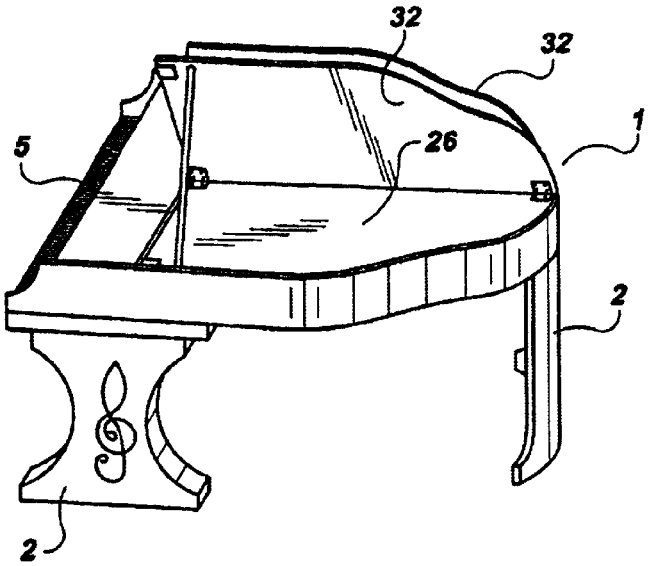
FIG. 1 depicts the piano housing according to the present invention.

Now referring to FIGS. 1 through 7, the present invention relates to a grand style piano having additional keys and strings for enhanced performance. The device comprises a conventional piano housing 1 supported a predetermined distance above a supporting surface with legs 2. The housing includes a front end having a keyboard 5 thereon. Immediately adjacent the keyboard are a pair of pivotal lids 32 providing selective access to a hollow interior 26 containing sound producing means therein. The sound producing means is primarily conventional and includes strings that are struck by hammers to produce a desired musical note.

Figure 2:
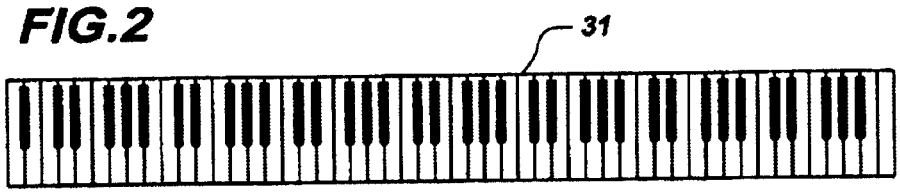
FIG. 2 depicts a conventional piano keyboard according to the present invention.
Figure 3:
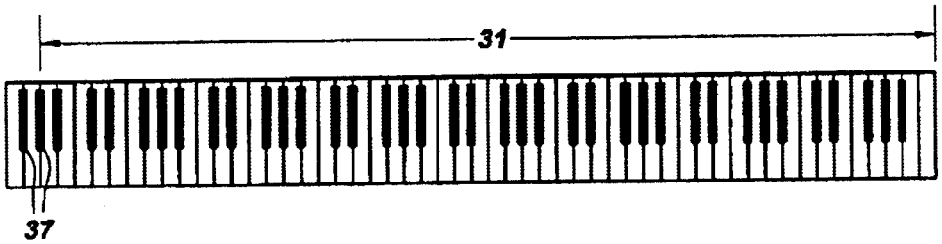
FIG. 3 is a top plan view of the keyboard according to the present invention.
Figure 4:
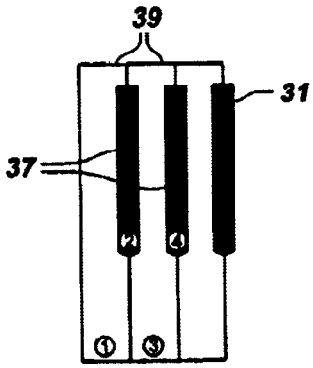
FIG. 4 is detailed view of the additional four keys included with the present invention.

As depicted in FIG. 2, a conventional keyboard includes 88 keys 31, 36 black keys and 52 white keys. The present invention includes an additional two black keys 37 and two white keys 39 all of which are positioned to the left of the aforementioned keys found on a conventional keyboard. Each of the conventional 88 keys are tuned up by four notes.

Figure 5:
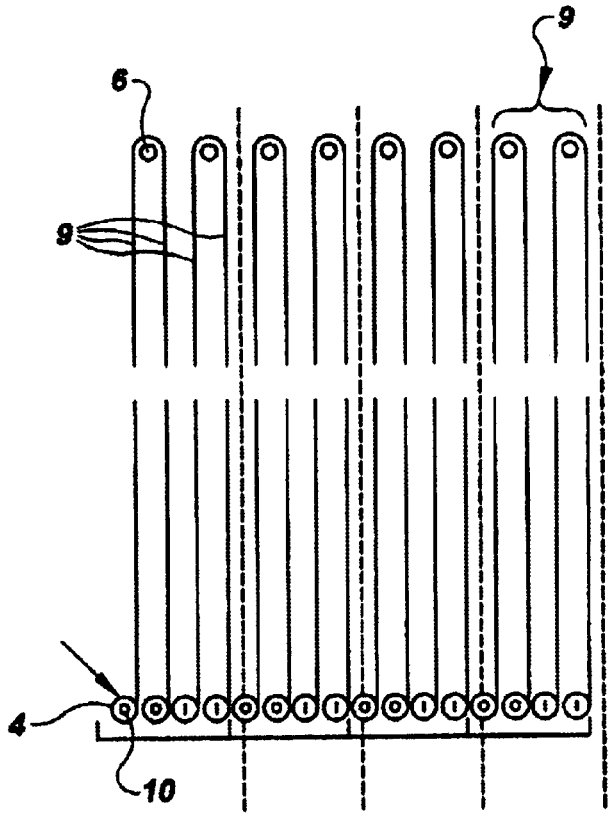
FIG. 5 is a top plan view of the string sets according to the present invention.

Now referring to FIG. 5, each key, when depressed, operates a hammer that strikes a set of four strings 9 to produce a desired sound or note. The four strings are formed by a pair of strings, each attached at a first end to a first tuning pin 4. The string is extended a predetermined distance and an intermediate portion is wrapped around a string pin 6; the second end is attached to a second tuning pill 10. The four strings created thereby are struck with a hammer (not pictured) driven by a designated key to produce a desired note or sound.

The advantage of the above described four string arrangement is now apparent. A conventional piano includes a set of three strings formed with a single string attached at each end to a tuning pin having an intermediate portion wrapped about a string pin. Each string is shared with an adjacent set to form a three string set. Accordingly, tuning a string will affect two notes. The four string construction according to the present invention allows each string to be separately tuned with its designated tuning pin without affecting any other notes.

Figure 6:
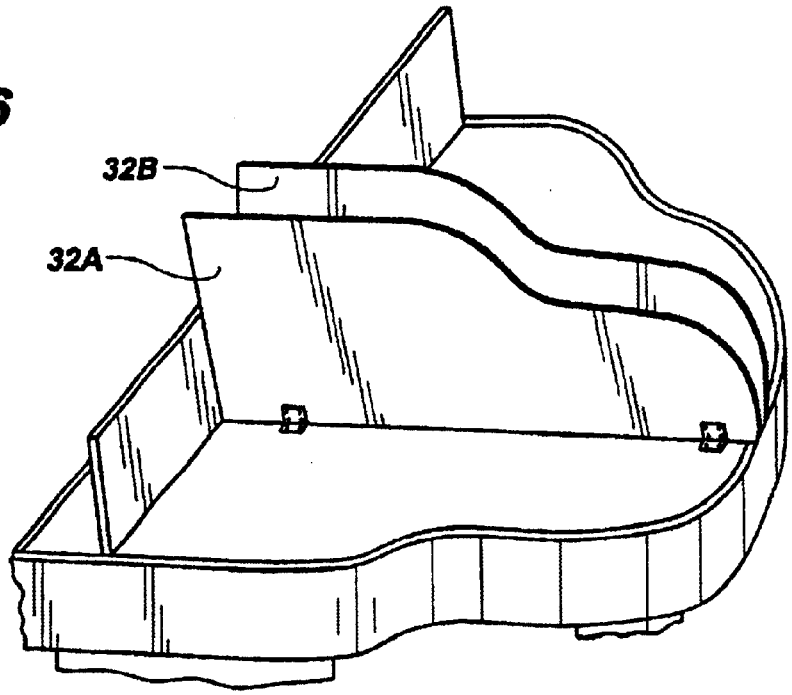
FIG. 6 depicts the pair of pivotal lids for exposing the treble and bass strings.
Figure 7:
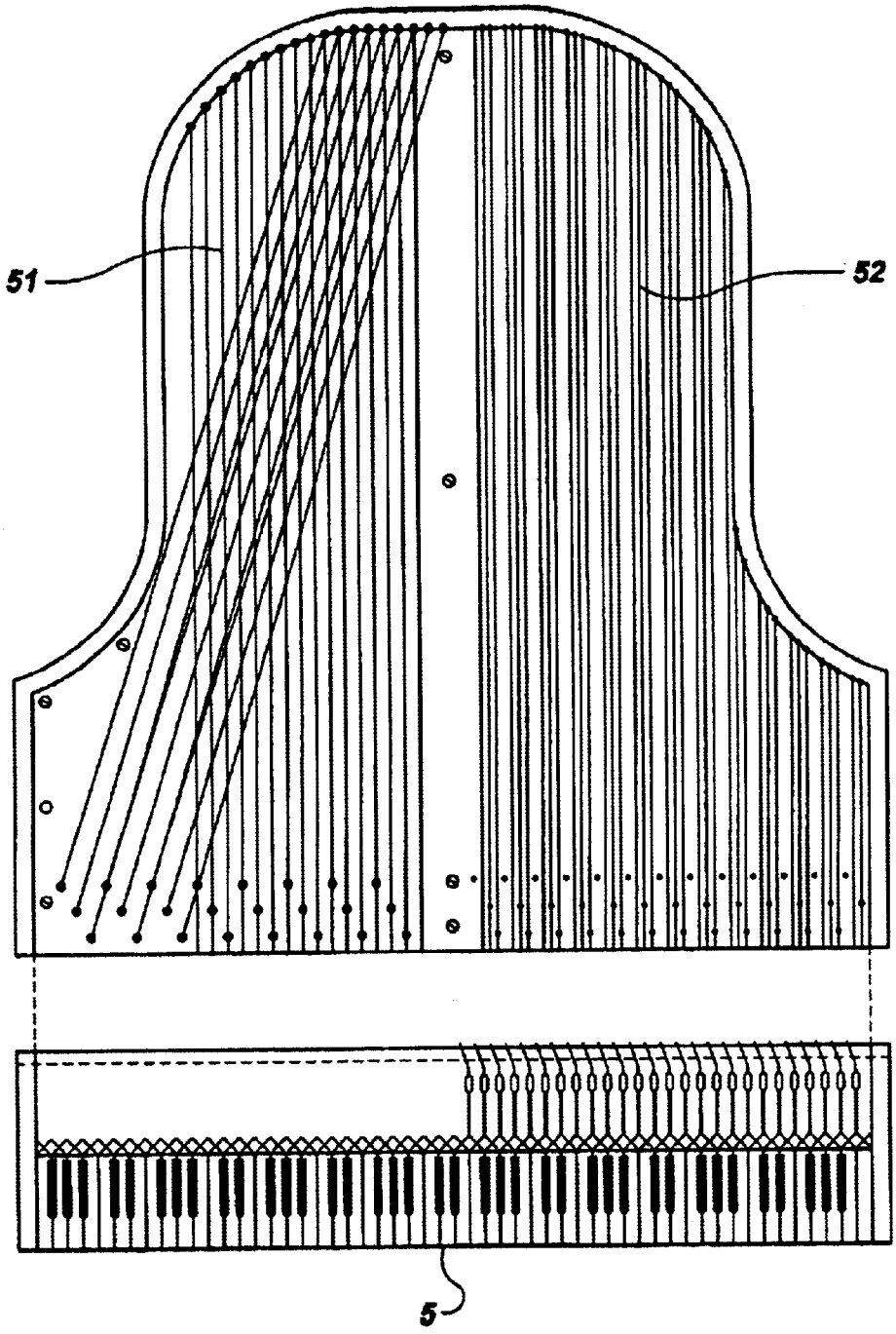
FIG. 7 depicts the segregated string arrangement according to the present invention.

Now referring to FIGS. 6 and 7, the piano according to the present invention may include a uniquely configured string arrangement for producing a desired sound quality. For example, with conventional pianos, all strings are arranged diagonally across a soundboard. As depicted in FIG. 7, with the present invention, the strings are arranged in a linear, parallel fashion with the bass strings 51 positioned on one side of the housing interior and the treble strings 52 positioned on an opposing side. The piano housing, therefore, includes a pair of pivotal lids 32, one 32A of which overlays the treble strings while the other 32B overlays the bass strings. Accordingly, a player can project more treble or bass by rasing or lowering the appropriate cover overlaying a given set of strings.

As indicated above, the present invention provides a uniquely designed piano having additional keys and notes thereby providing a greater range within which a user may play. However, the device is not limited to the exact details of construction and enumeration of parts described above. For example, the size, shape and materials and construction of the device may be varied to suit a particular application.

Although there has been shown and described the preferred embodiment of the present invention, it will be readily apparent to those skilled in the all that modifications may be made thereto which do not exceed the scope of the appended claims. Therefore, the scope of the invention is only to be limited by the following claims

What is claimed is:

1. A piano comprising:

a housing having a hollow interior with a sound producing means received therein for producing a plurality of musical notes;

a keyboard positioned on said housing, said keyboard having at least 92 keys thereon, each of said keys operating said sound producing means to produce a discrete note when depressed, said sound producing means including at least 92 sets of strings, each set including four strings dedicated to a designated key on said keyboard; said four strings formed by a pair of strings, each having first and second ends, and an intermediate portion therebetween with the first end attached to a first tuning pin, the intermediate portion wrapped around a string pin and the second end attached to a second tuning pin whereby each of said four strings are separately tuned without affecting the sound quality produced by any other of said keys;

a hammer operably connected with each of said keys, said hammer striking said set of strings when said designated key is depressed to produce a desired note.

2. The piano according to claim 1 wherein said at least 92 keys includes at least 54 white keys and 38 black keys.

3. The piano according to claim 1 wherein said strings are segregated with a plurality of treble strings on a first side of the interior of said housing and a plurality of bass strings positioned on an opposing side of the interior of said housing.

4. The piano according to claim 3 wherein said housing further includes:

a pair of pivotal lids, a first of said lids overlaying said treble strings and a second of said lids overlaying said bass strings allowing a user to selectively expose either of said treble strings and said bass strings.

5. A piano comprising:

a housing having a hollow interior with a sound producing means received therein for producing a plurality of musical notes;

a keyboard positioned on said housing, said keyboard having a plurality of keys thereon, each of said keys operating said sound producing means to produce a discrete note when depressed;

a plurality of sets of strings, each set of strings including at least four strings dedicated to a designated key, said at least four strings struck by a hammer operated by said designated key, said at least four strings producing a discrete note when struck by said hammer.

6. The piano according to claim 5 wherein said at least four strings are formed by a pair of strings, each string having first and second ends, and an intermediate portion therebetween, the first end attached to a first tuning pin, the intermediate portion wrapped around a string pin and the second end attached to a second tuning pin whereby each of said four strings can be separately tuned without affecting the sound quality produced by any other of said keys.

* * * * *